US007565804B1

(12) United States Patent
Frash et al.

(10) Patent No.: US 7,565,804 B1
(45) **Date of Patent: *Jul. 28, 2009**

(54) FLAMEHOLDER FUEL SHIELD

(75) Inventors: Martin Wayne Frash, Newburyport, MA (US); Brian Benscoter Roberts, Malden, MA (US)

(73) Assignee: General Electric Company, Schenectady, NY (US)

( * ) Notice: Subject to any disclaimer, the term of this patent is extended or adjusted under 35 U.S.C. 154(b) by 427 days.

This patent is subject to a terminal disclaimer.

(21) Appl. No.: 11/478,229

(22) Filed: Jun. 29, 2006

(51) Int. Cl.
*F02K 3/105* (2006.01)

(52) U.S. Cl. ..... 60/762; 60/761; 60/765

(58) Field of Classification Search ..... 60/761–766
See application file for complete search history.

(56) References Cited

U.S. PATENT DOCUMENTS

| | | | | |
|---|---|---|---|---|
| 2,693,083 | A | 11/1954 | Abbott | |
| 2,780,061 | A | 2/1957 | Clarke et al. | |
| 2,780,916 | A | 2/1957 | Collins | |
| 2,799,991 | A * | 7/1957 | Conrad | 60/749 |
| 2,861,424 | A | 11/1958 | Jurisch | |
| 2,872,785 | A | 2/1959 | Barrett et al. | |
| 2,920,445 | A | 1/1960 | Bailey | |
| 3,054,259 | A | 9/1962 | Arthur et al. | |
| 3,176,465 | A | 4/1965 | Colley | |
| 3,756,178 | A * | 9/1973 | Frostmann | 112/475.23 |
| 3,765,178 | A * | 10/1973 | Hufnagel et al. | 60/765 |
| 3,800,527 | A | 4/1974 | Marshall et al. | |
| 4,064,691 | A | 12/1977 | Nash | |
| 4,312,185 | A | 1/1982 | Nash et al. | |
| 4,445,339 | A | 5/1984 | Davis et al. | |
| 4,490,973 | A | 1/1985 | Kinsey | |
| 4,813,229 | A | 3/1989 | Simmons | |
| 4,887,425 | A | 12/1989 | Vdoviak | |
| 4,989,407 | A | 2/1991 | Grant | |
| 5,001,898 | A | 3/1991 | Holladay | |
| 5,020,318 | A | 6/1991 | Vdoviak | |
| 5,076,062 | A | 12/1991 | Abreu | |
| 5,142,858 | A | 9/1992 | Ciokajlo et al. | |
| 5,396,763 | A * | 3/1995 | Mayer et al. | 60/765 |
| 5,813,221 | A | 9/1998 | Geiser et al. | |
| 6,112,516 | A * | 9/2000 | Beule et al. | 60/765 |

OTHER PUBLICATIONS

J.C. Mayer et al, U.S. Appl. No. 11/478,246, filed Jun. 29, 2006, entitled "Purged Flameholder Fuel Shield,".

* cited by examiner

*Primary Examiner*—Michael Cuff
*Assistant Examiner*—Phutthiwat Wongwian
(74) *Attorney, Agent, or Firm*—William S. Andes; Francis L. Conte

(57) ABSTRACT

A fuel shield is configured for use in the afterburner of a turbofan aircraft engine. The shield includes wings obliquely joined together at a nose, with each of the wings including an offset mounting tab at a proximal end thereof. The wings and tabs are configured to complement a flameholder vane around its leading edge, with the tabs contacting the vane sidewalls to offset the wings outwardly therefrom and form a thermally insulating gap therebetween.

23 Claims, 7 Drawing Sheets

FLAMEHOLDER FUEL SHIELD

The U.S. Government may have certain rights in this invention in accordance with Contract No. N00019-03-D-003 awarded by the Department of the Navy.

BACKGROUND OF THE INVENTION

The present invention relates generally to gas turbine engines, and, more specifically, to augmented turbofan engines.

The typical turbofan gas turbine aircraft engine includes in serial flow communication a fan, compressor, combustor, high pressure turbine (HPT), and low pressure turbine (LPT). Inlet air is pressurized through the fan and compressor and mixed with fuel in the combustor for generating hot combustion gases.

The HPT extracts energy from the combustion gases to power the compressor through a corresponding drive shaft extending therebetween. The LPT extracts additional energy from the combustion gases to power the fan through another drive shaft extending therebetween.

In the turbofan engine, a majority of the pressurized fan air bypasses the core engine through a surrounding annular bypass duct and rejoins the core exhaust flow at the aft end of the engine for collectively providing the propulsion thrust for powering an aircraft in flight.

Additional propulsion thrust may be provided in the engine by incorporating an augmentor or afterburner at the aft end of the engine. The typical afterburner includes a flameholder and cooperating fuel spraybars which introduce additional fuel in the exhaust discharged from the turbofan engine. The additional fuel is burned within an afterburner liner for increasing the propulsion thrust of the engine for limited duration when desired.

A variable area exhaust nozzle (VEN) is mounted at the aft end of the afterburner and includes movable exhaust flaps. The flaps define a converging-diverging (CD) nozzle which optimizes performance of the engine during non-augmented, dry operation of the engine at normal thrust level, and during augmented, wet operation of the engine when additional fuel is burned in the afterburner for temporarily increasing the propulsion thrust from the engine.

Flameholders have various designs and are suitably configured to hold or maintain fixed the flame front in the afterburner. The exhaust flow from the turbofan engine itself has relatively high velocity, and the flameholder provides a bluff body to create a relatively low velocity region in which the afterburner flame may be initiated and maintained during operation.

One embodiment of the flameholder that has been successfully used for many years in military aircraft around the world includes an annular flameholder having a row of flameholder or swirl vanes mounted between radially outer and inner shells. Each of the vanes has opposite pressure and suction sidewalls extending axially between opposite leading and trailing edges.

The aft end of each vane includes a generally flat aft panel facing in the aft downstream direction which collectively provide around the circumference of the flameholder a protected, bluff body area effective for holding the downstream flame during augmentor operation. In one embodiment, the aft panel includes a series of radial cooling slots fed with a portion of un-carbureted exhaust flow received inside each of the vanes for providing cooling thereof during operation.

Since the flameholders are disposed at the aft end of the turbofan engine and are bathed in the hot exhaust flow therefrom they have a limited useful life due to that hostile thermal environment. Furthermore, when the afterburner is operated to produce additional combustion gases aft therefrom further heat is generated thereby, and also affects the useful life of the afterburner, including in particular the flameholder itself.

An additional problem has been uncovered during use of this exemplary engine due to the introduction of fuel into the flameholder assembly. This exemplary afterburner includes a row of main fuel spraybars and a fewer number of pilot fuel spraybars dispersed circumferentially therebetween. For example, each vane may be associated with two main spraybars straddling the leading edge thereof, and every other vane may include a pilot spraybar before the leading edge thereof.

The pilot spraybars are used to introduce limited fuel during the initial ignition of the afterburner followed by more fuel injected from the main spraybars. The pilot fuel is injected against the leading edges of the corresponding pilot vanes and spreads laterally along the opposite sidewalls of the vanes prior to ignition thereof.

Experience in operating engines has shown that the relatively cold pilot fuel creates thermal distress in the pilot vanes during operation, and limits the useful life thereof. All the flameholder vanes, including the pilot vanes, operate at relatively high temperature especially during afterburner operation, and the introduction of the pilot fuel introduces corresponding temperature gradients in the pilot vanes which increase thermal stress therein.

Accordingly, the cyclical operation of the afterburner leads to greater thermal distress in the pilot vanes than the other, non-pilot vanes and can eventually induce thermal cracking in the leading edge region of the pilot vanes. These cracks then permit ingestion of pilot fuel inside the pilot vane and undesirable combustion therein which then leads to further thermal distress, spallation, and life-limited damage to the aft panels of the pilot vanes.

It is therefore desired to provide an improved afterburner flameholder for increasing the useful life thereof.

BRIEF DESCRIPTION OF THE INVENTION

A fuel shield is configured for use in the afterburner of a turbofan aircraft engine. The shield includes wings obliquely joined together at a nose, with each of the wings including an offset mounting tab at a proximal end thereof. The wings and tabs are configured to complement a flameholder vane around its leading edge, with the tabs contacting the vane sidewalls to offset the wings outwardly therefrom and form a thermally insulating gap therebetween.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
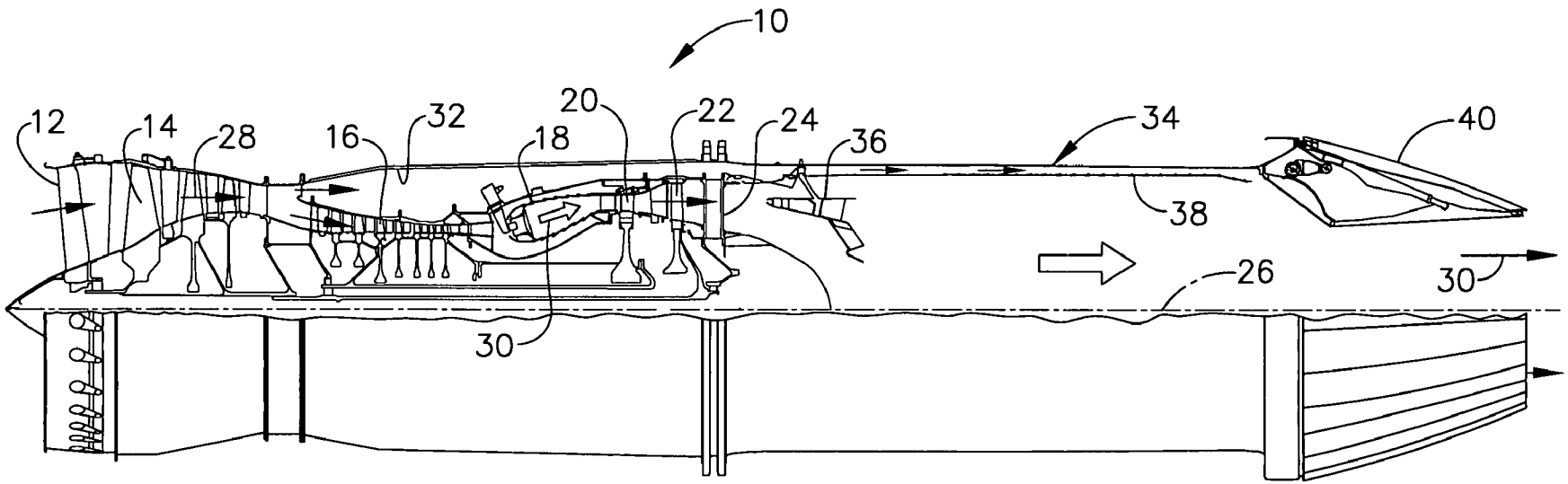
FIG. 1 is an axial sectional schematic view of exemplary turbofan aircraft gas turbine engine having an afterburner.

Illustrated schematically in FIG. 1 is an aircraft turbofan gas turbine engine 10 configured for powering an aircraft in flight. The engine includes in serial flow communication a row of variable inlet guide vanes (IGVs) 12, multistage fan 14, multistage axial compressor 16, combustor 18, single stage high pressure turbine (HPT) 20, single stage low pressure turbine (LPT) 22, and a rear frame 24 all coaxially disposed along the longitudinal or axial centerline axis 26.

During operation, air 28 enters the engine through the IGVs 12 and is pressurized in turn through the fan 14 and compressor 16. Fuel is injected into the pressurized air in the combustor 18 and ignited for generating hot combustion gases 30.

Energy is extracted from the gases in the HPT 20 for powering the compressor 16 through a drive shaft extending therebetween. Additional energy is extracted from the gases in the LPT 22 for powering the fan 14 through another drive shaft extending therebetween.

An annular bypass duct 32 surrounds the core engine and bypasses a portion of the pressurized fan air from entering the compressor. The bypass air joins the combustion gases downstream of the LPT which are collectively discharged from the engine for producing propulsion thrust during operation.

The turbofan engine illustrated in FIG. 1 also includes an augmentor or afterburner 34 at the aft end thereof. The afterburner includes an annular flameholder assembly 36 at the upstream end thereof, and an annular afterburner liner 38 extends downstream therefrom. Additional fuel is suitably injected into the flameholder during operation for mixing with the exhaust flow from the turbofan engine and producing additional combustion gases contained within the flameholder liner 38.

A variable area exhaust nozzle (VEN) 40 is disposed at the aft end of the afterburner and includes a row of movable exhaust flaps which are positionable to form a converging-diverging (CD) exhaust nozzle for optimizing performance of the engine during both dry, non-augmented operation and wet, augmented operation of the engine.

The basic engine illustrated in FIG. 1 is conventional in configuration and operation, and as indicated above in the Background section has experienced many years of successful use throughout the world. The annular flameholder 36 thereof is also conventional in this engine and is modified as described hereinbelow for improved durability thereof.

Figure 2:
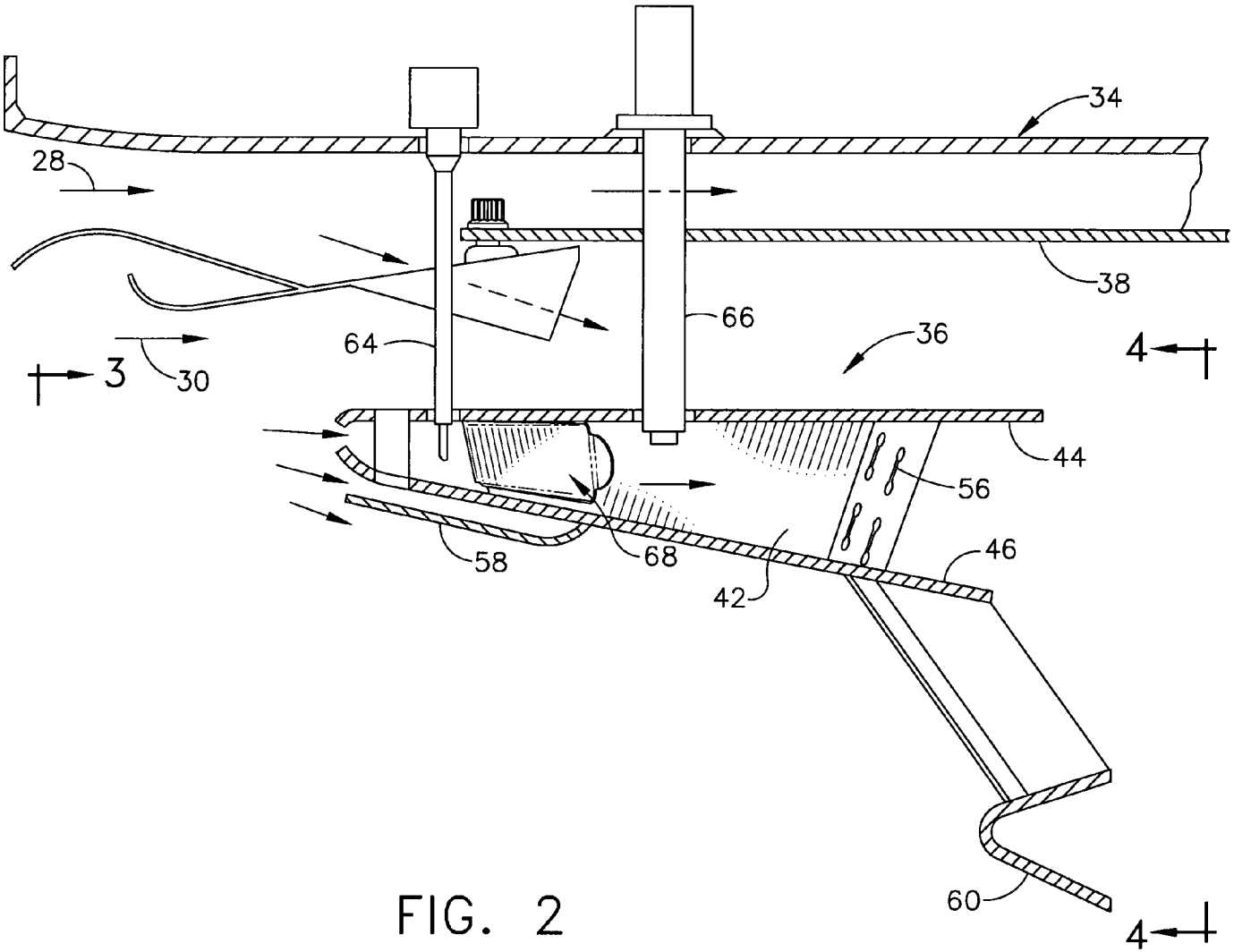
FIG. 2 is an enlarged axial sectional view of a portion of the annular flameholder assembly in the afterburner illustrated in FIG. 1.
Figure 3:
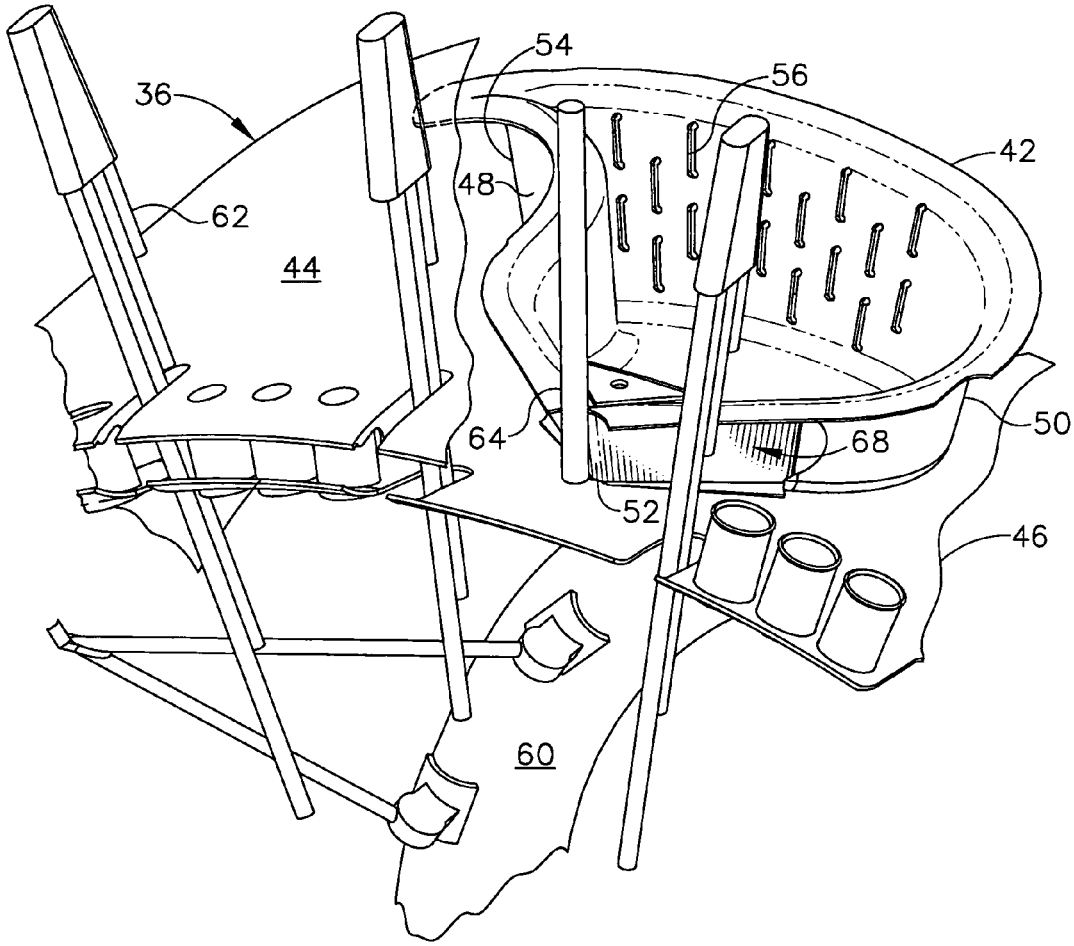
FIG. 3 is a forward-facing-aft isometric view of a portion of the flameholder illustrated in FIG. 2 and taken along line 3-3.
Figure 4:
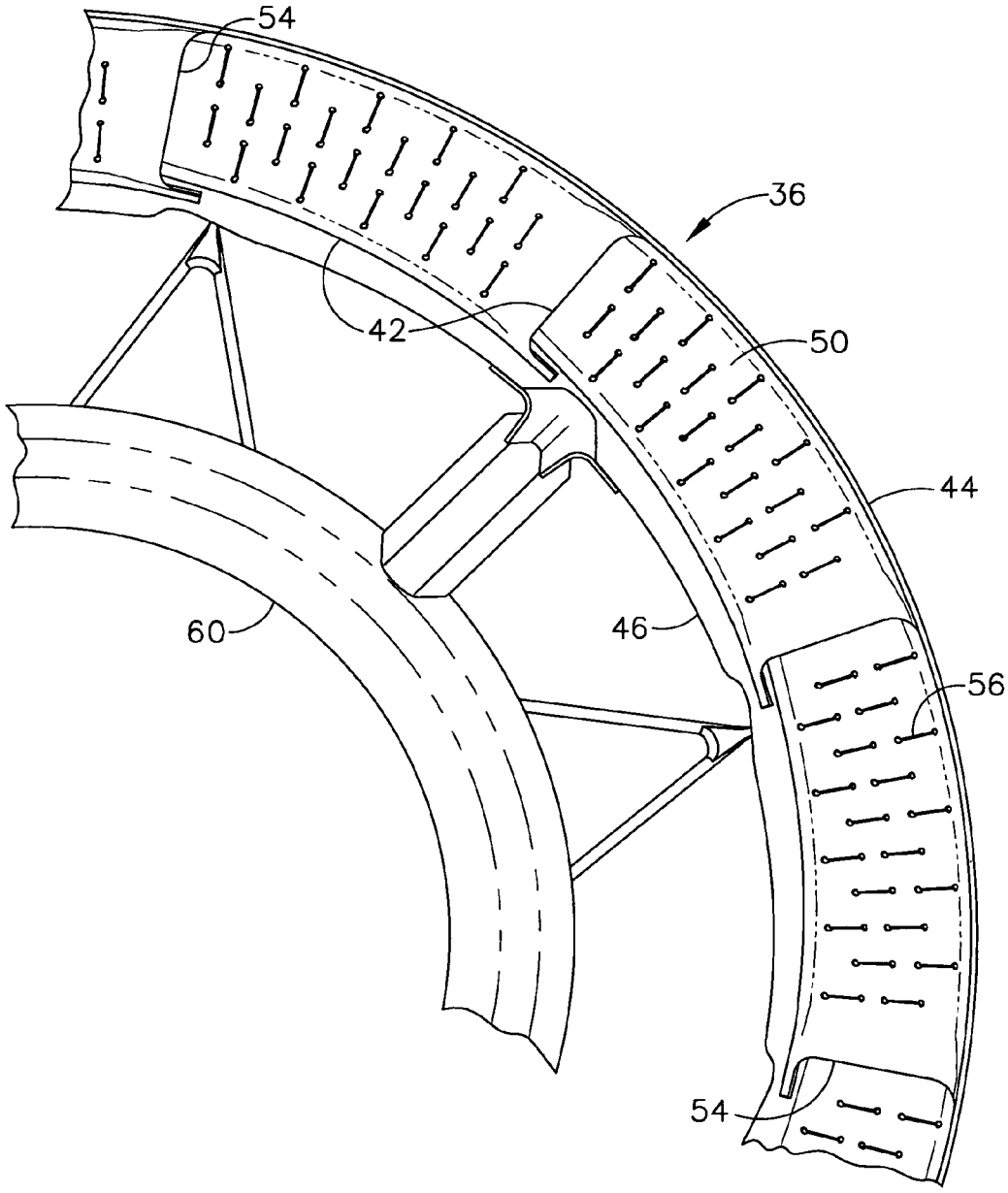
FIG. 4 is a aft-facing-forward view of a portion of the flameholder illustrated in FIG. 2 and taken along line 4-4.

The upstream portion of the afterburner 34 is illustrated in more detail in FIG. 2, with FIGS. 3 and 4 illustrating forward and aft views of the exemplary annular flameholder assembly 36 thereof.

The flameholder assembly includes a row of flameholder or swirl vanes or partitions 42 fixedly joined, by brazing for example, to radially outer and inner shells 44,46. Each of the vanes 42 is hollow, as best illustrated in FIG. 3, and includes a first or pressure sidewall 48 and a circumferentially opposite second or suction sidewall 50 extending axially between opposite leading and trailing edges 52,54.

Figure 5:
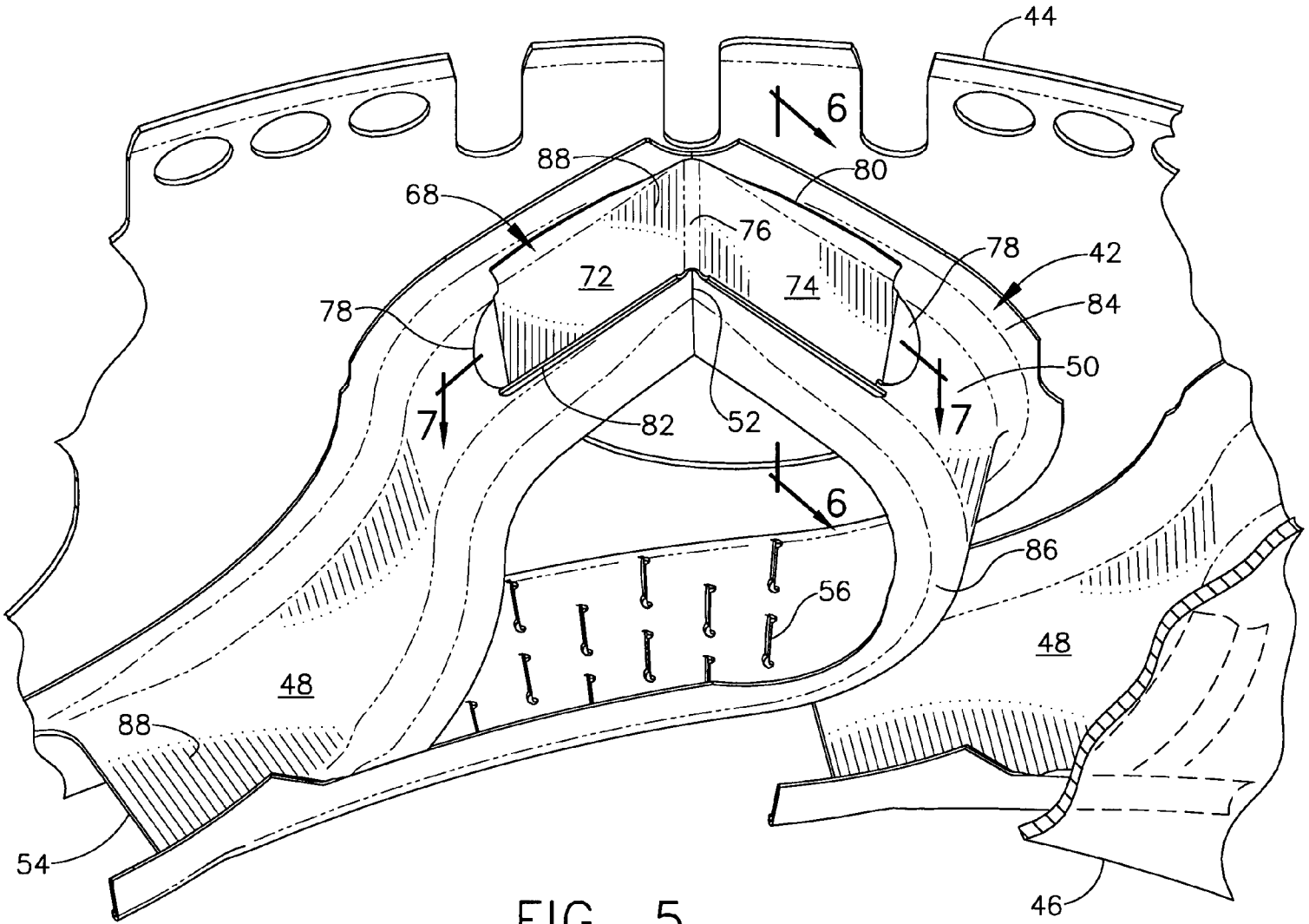
FIG. 5 is an enlarged, isometric view of an exemplary pilot flameholder vane illustrated in FIGS. 2 and 3, and including a fuel shield thereon.

The two sidewalls 48,50 as best illustrated in FIGS. 3 and 5 are generally flat and symmetrical where they join together at the leading edge 52 at an included angle of about 90 degrees. The first sidewall 48 is generally concave aft therefrom and is imperforate between the leading and trailing edges.

The second sidewall 50 is generally convex and is imperforate from the leading edge aft to about the maximum width of the vane. The second sidewall includes a generally flat aft panel that forms circumferentially with the adjoining vanes a substantially flat annular bluff body having flameholder capability as illustrated in part in FIG. 4.

The aft panels include a pattern of radial discharge slots 56 which are fed by an upstream scoop 58 shown in FIG. 2 which receives a portion of the un-carbureted exhaust flow from the turbofan engine. Exhaust flow is channeled through the scoop 58 and an inlet aperture in the inner shell 46 to feed the inside of each of the vanes with the exhaust flow. This internal exhaust flow cools the vanes during operation, and is discharged through the exit slots 56 in the aft panels for providing thermal insulation against the hot combustion gases generated downstream in the afterburner during operation.

The row of vanes 42 thusly defines an outer flameholder, and a cooperating annular inner flameholder 60 is mounted concentrically therein by a plurality of supporting links or bars shown in FIGS. 3 and 4. And, a radial crossover gutter extends between the aft end of the inner shell 46 and the inner flameholder 60 as illustrated in FIGS. 2 and 4 to maintain ignition flow communication therebetween.

As shown in FIG. 3, a plurality of main fuel injectors or spraybars 62 are distributed circumferentially in a row before the row of flameholder vanes 42. For example, two main spraybars 62 are provided for each of the vanes 42 and straddle each vane on circumferentially opposite sides of the leading edge 52.

A smaller plurality of pilot fuel injectors or spraybars 64 are positioned before the corresponding leading edges 52 in a one-to-one correspondence with corresponding ones of the flameholder vanes, also referred to as pilot vanes 42. For example, a pilot spraybar 64 may be located before the leading edge of every other vane 42 and therefore have a total number which is half that of the total number of vanes 42.

As shown in FIGS. 2 and 3, the outer and inner shells 44,46 extend both upstream from the leading edges of the vanes 42 and downstream from the trailing edges thereof and diverge radially in the downstream aft direction therebetween. The leading edges of the two shells form an annular inlet through which a portion of the engine exhaust 30 is received during operation.

The two shells are jointed together along their leading edges by a row of radially extending tubes. And, the shells have a series of U-shaped slots along the leading edges thereof which receive respective ones of the main and pilot spraybars when assembled.

As shown in FIGS. 3 and 5, the vanes 42 are spaced apart circumferentially and define therebetween flow passages in which the injected fuel mixes with the exhaust flow for providing the fuel and air mixture that is ignited in the afterburner during operation. The inter-vane flow passages initially converge in the axial downstream direction and then may diverge from the maximum width of the vanes to their trailing edges in accordance with conventional practice.

The resulting configuration of the vane passages is therefore a relatively complex 3-D cooperation of the vanes and shells.

During operation, fuel is suitably channeled through the pilot spraybars 64 and injected in front of the pilot vanes where it mixes with exhaust flow from the turbofan engine and is suitably ignited by an electrical igniter 66 illustrated in FIG. 2 for initiating the afterburner combustion flame. Additional fuel is injected through the main spraybars 62 at different radial locations within the flameholder assembly and adds to the combustion flame which is held by the outer flameholder defined by the vanes 42 and the inner flameholder 60 having the form of an annular V-gutter facing in the downstream direction.

The afterburner 34 and the basic flameholder assembly 36 described above are conventional in configuration and operation and are found in the exemplary turbofan engine described above in the Background which has experienced many years of successful commercial use throughout the world.

However, the pilot spraybars 64 described above inject relatively cold fuel against the leading edge 52 of the pilot vanes 42 during operation which leads to substantial gradients in temperature of the pilot vanes. This temperature gradient then leads to thermal distress over many cycles of operation of the engine. The pilot vanes are thusly limited in life by thermally induced cracks in the leading edge regions thereof through which pilot fuel may enter, ignite, and heat the vanes from inside leading to premature failure of the aft panels.

Accordingly, the conventional flameholder described above is modified as described hereinbelow for protecting the pilot vanes 42 against the cold quenching affect of the injected pilot fuel for substantially increasing the useful life of the flameholder assembly well beyond that of the conventional flameholder.

The problem of fuel quenching of the leading edge regions of the pilot vanes 42 is solved by introducing a plurality of identical fuel shields 68 suitably attached to corresponding ones of the pilot vanes 42 behind the corresponding pilot spraybars 64. Each fuel shield is configured to aerodynamically match or complement the leading edge region of each pilot vane and suitably covers this region to prevent direct impingement of the injected fuel thereagainst.

The fuel shields 68 are shown in several views in FIGS. 2, 3 and 5 and are introduced solely at the pilot vanes 42 corresponding with the pilot spraybars, and not on the remainder of flameholder vanes which are not subject to fuel quenching along their leading edges.

Figure 6:
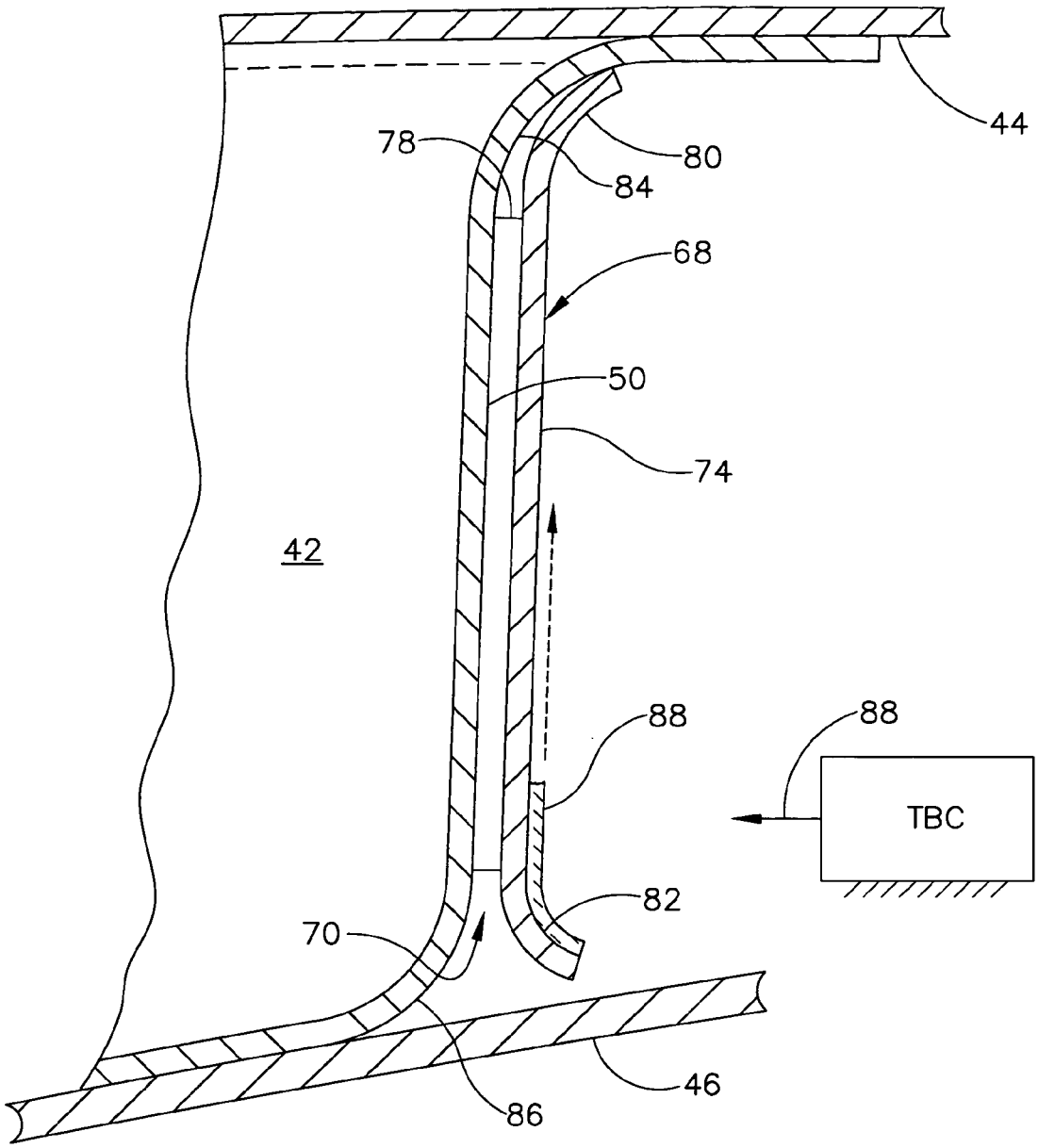
FIG. 6 is a radial sectional view through the fuel shield and pilot vane illustrated in FIG. 5 and taken along line 6-6.
Figure 7:
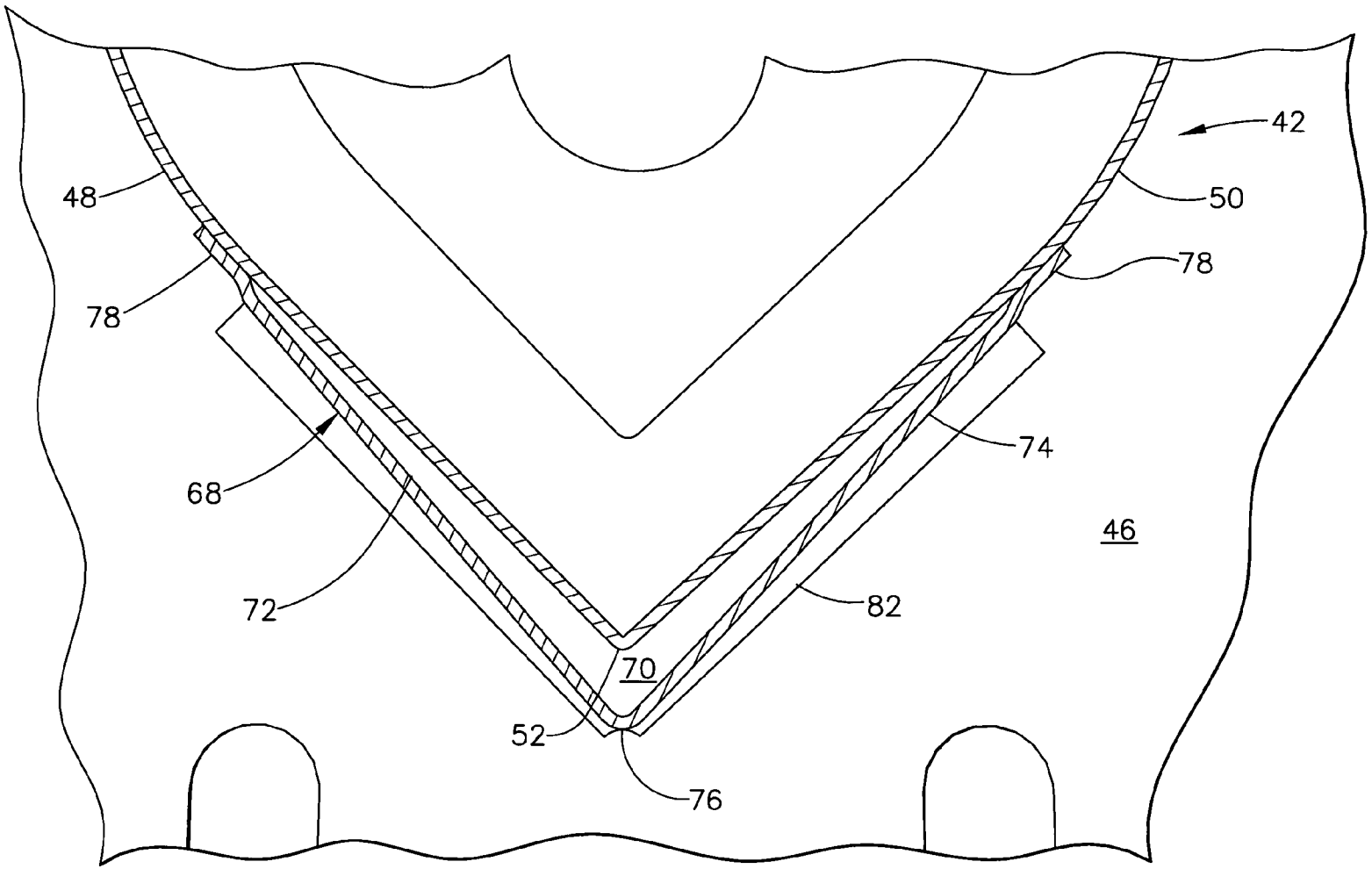
FIG. 7 is a circumferential sectional view through the fuel shield and pilot vane illustrated in FIG. 5 and taken along line 7-7.

FIG. 5 shows an enlarged isometric view of one of the fuel shields 68 bridging the leading edge of the pilot vane 42, and FIGS. 6 and 7 illustrate corresponding radial and circumferential sectional views thereof. These three figures illustrate the aerodynamic configuration of the fuel shields 68 conforming with the 3-D configuration of the leading edge region of the pilot vanes 42 between the outer and inner and shells 44,46.

The shields are suitably mounted to the vane 42 itself to provide a thermally insulating space or gap 70 around the vane leading edge for protecting the leading edge from quenching by the cool pilot fuel when injected. In this way, the leading edge region of each vane behind the fuel shield is then permitted to operate at a higher temperature than previously obtained under fuel quenching, which correspondingly reduces the thermal gradients in this region of the pilot vane, and in turn substantially reduces thermal distress. Accordingly, the useful life of the flameholder assembly is increased dramatically, as confirmed by testing thereof with the additional fuel shields.

The fuel shield illustrated in FIG. 5 includes a pair of first and second imperforate thin plates or wings 72,74 which are integrally joined together obliquely at a common apex or nose 76 that defines the unsupported or cantilevered forward distal ends thereof. Each of the wings 72,74 also includes an offset mounting tab 78 at the opposite aft proximal end thereof which fixedly mount each fuel shield to the pilot vane.

The two tabs 78 may be initially tack welded to the vane and then brazed thereto over the full surface area thereof. The fuel shield therefore covers the leading edge region of each pilot vane, with the first wing 72 extending aft over the first sidewall 48 of the vane and fixedly joined thereto at the corresponding tab 78, and the second wing 74 similarly covering the second sidewall 50 of the vane and attached thereto at its corresponding tab 78.

The flameholder vanes 42 themselves are made of suitable heat resistant metal for use in the hostile environment of the afterburner, and correspondingly the fuel shields 68 may be made of similar or different heat resistant metal. For example, the fuel shields may be formed from a nickel based superalloy such as Inconel™ 625 which is commercially available for use in gas turbine engines.

As shown in FIGS. 6 and 7, each of the wings 72,74 is preferably flat, and each tab 78 is offset in depth or thickness therefrom. In this way, the wings and tabs may be configured to complement the corresponding portions of the flameholder vanes 42 around the leading edge 52 thereof to maintain the aerodynamic profile of the corresponding pilot vanes to minimize performance loss due to the introduction of the fuel shield.

The tabs 78 define arcuate extensions of the wings extending across the full width thereof and contact the corresponding sidewalls 48,50 for being rigidly mounted thereto by tack welding and brazing. The offset tabs in turn offset the wings outwardly from the corresponding portions of the two sidewalls 48,50 around the leading edge 52 of the pilot vanes to form the insulating gap 70 therebetween.

The fuel shields 68 thusly protect the leading edge region of each pilot vane from direct contact with the injected pilot fuel over the corresponding area thereof and permit the leading edge region of the vane to operate at a higher temperature and thereby reduce thermal gradients with the remainder of the pilot vane.

Since the pilot vane 42 initially diverges in the downstream direction on both sides of the leading edge 52, the corresponding fuel shields 68 similarly diverge to complement the 3-D configuration of the vane. As shown in FIG. 7, the two wings of the fuel shield are oblique with each other with an included angle therebetween of about 90 degrees, and conform generally with the corresponding configuration of the vane around its leading edge 52.

Although the fuel shield 68 is fixedly attached to the pilot vane by the two end tabs 78, the oblique configuration of the two wings permit substantially unrestrained thermal expansion and contraction of the fuel shield with elastic bending around the nose 76 to ensure a suitable useful life of the fuel shield itself which is now subject to thermal quenching by the injected pilot fuel.

The two wings of each fuel shield preferably include corresponding radially outer and radially inner gutters 80,82 extending laterally outwardly therefrom and between the common nose 76 and the two opposite tabs 78 as initially shown in FIG. 5. The outer gutters 80 are joined to the radially outer edges of both wings 72,74 at corresponding arcuate or concave fillets. Similarly, the inner gutters 82 are joined to the radially inner edges of the two wings 72,74 by corresponding arcuate or concave fillets.

And, the gutters and their concave fillets face outwardly away from the sidewalls of the pilot vane, and away from the corresponding supporting tabs 78 which are offset inwardly from the two wings 72,74 oppositely from the outer and inner gutters.

The gutters conform generally with the configuration of the pilot vane where it joins the outer and inner shells for maintaining aerodynamic performance of the vanes while improving the performance of the fuel shield itself. And, the outer and inner gutters are preferably different from each other to provide different performance during operation.

More specifically, the flameholder vanes 42 illustrated in FIG. 5 are preferably sheet metal fabrications suitably joined, by brazing for example, to the corresponding outer and inner shells 44,46. In particular, each vane 42 includes a radially outer, concave fillet 84 defined by an outward lateral flange to blend and join the sidewalls to the outer shell 44 by brazing. Correspondingly, each vane 42 also includes a radially inner, convex bullnose 86 defined by a corresponding inward flange which blends and joins the inner ends of the sidewalls to the inner shell 46 by brazing.

Correspondingly, the outer gutters 80 of the two wings conform with the outer fillet 84 as illustrated in FIG. 6, with the concave fillet of the outer gutter facing outwardly and corresponding with the outwardly facing concave fillet 84 at the junction between the vanes and outer shell. In contrast, the inner gutters 82 are again concave outwardly from the sidewalls of the vanes, but diverge from the corresponding inner bullnoses 86 which are convex outwardly.

The outer gutters 80 as illustrated in FIGS. 5 and 6 preferably contact the outer fillets 84 along the full length of the gutters to protect the vane sidewalls and outer fillet from quenching by the injected pilot fuel.

The inner gutters 82 as shown in FIG. 6 preferably terminate short of the inner shell 46 to provide a small radial space therebetween along the entire length of the inner gutters to provide additional advantage. Firstly, the so truncated inner gutter 82 only partly covers the bullnoses 86 and permits visual inspection of the brazed joint between the inner bullnose 86 and the inner shell 46 during the manufacturing process. Furthermore, the so truncated inner gutter 82 also provides a suspended edge along which the injected pilot fuel undergoes slinging or shearing when mixing with the high velocity incoming exhaust flow leading to enhanced vaporization thereof.

In the preferred embodiment illustrated in FIG. 6, the inner gutters 82 diverge in the radially inner direction away from the corresponding wings 72,74 at a greater divergence angle than that of the outer gutters 80. For example, the outer gutters diverge at about 60 degrees, whereas the inner gutters diverge at about 85 degrees from the flat plane of the wings.

The shallow divergence of the outer gutters permits smooth blending between the wings and the outer fillet and shell for smooth aerodynamic performance. And, the large divergence of the inner gutters 82 enhances fuel slinging during operation while also permitting full coverage of conventional thermal barrier coating (TBC) 88.

Thermal barrier coatings are conventional in modern gas turbine engines. The TBC 88 is a thermally insulating ceramic material sprayed on metal components during the manufacturing process. The entire external surfaces of the flameholder vanes and fuel shields shown in FIG. 5 for example, are suitably covered with the TBC 88 to enhance their useful life.

A large divergence angle of the inner gutters 82 illustrated in FIG. 6 should not exceed about 90 degrees to avoid shadowing of the applied TBC which would prevent full coverage of the TBC along the inner gutter itself.

As shown in FIGS. 5 and 7, the outer and inner gutters 80,82 preferably taper and increase in size from the central nose 76 to the opposite end tabs 78. The gutters are relatively short near their junction with the central nose 76 and increase in height or extension from the corresponding wings in the downstream directions along the opposite sidewalls of the vane where the gutters terminate at the corresponding end tabs. In this way, the gutters contain the spreading injected pilot fuel as it plumes in its downstream travel from the leading edge of the vane.

Furthermore, the outer gutter 80 illustrated in FIG. 5 preferably varies in fillet radius between the nose 76 and the two end tabs 78, with the fillet radius increasing therebetween to conform with the increasing size of the outer gutter for collectively conforming with the 3-D configuration of the pilot vane 42 where it blends with the outer shell 44.

Correspondingly, the inner gutters 82 preferably have a substantially constant fillet radius between the nose 76 and two end tabs 78 to provide a uniform slinging effect for the pilot fuel.

The individual fuel shield 68 including it constituent wings 72,74, gutters 80,82, nose 76, and tabs 78 is preferably formed from a unitary sheet of metal suitably bent to the complex 3-D shape required to conform with the 3-D configuration of the leading edge region of the pilot vane 42 illustrated in FIG. 5 between the diverging outer and inner shells 44,46. The two wings 72,74 remain substantially flat with the outer and inner gutters 80,82 being bent outwardly therefrom along corresponding concave fillets. And, the two end tabs 78 are simply offset from the corresponding wings by introducing a sharp dog-leg bend therebetween.

Since the fuel shields may be initially formed from sheet metal, suitable notches are provided between the outer and inner gutters on opposite sides of the central nose 76 to permit unrestrained bending of the two wings around the nose to the desired oblique included angle therebetween.

In alternate embodiments, the fuel shield 68 could be cast to shape, including even more complex 3-D shapes as required for the particular application, but casting is more expensive than sheet metal fabrication.

In the preferred embodiment illustrated in FIG. 7, the two wings 72,74 increase in spacing from the corresponding sidewalls 48,50 between the end tabs 78 and the central nose 76, with the nose 76 being aligned with the vane leading edge 52. In this way, the thermally insulating effect of the gap 70 is greatest at the leading edge 52 of the vane and decreases in the downstream direction along both sidewalls 48,50 over a suitable extent corresponding with the injection of the pilot fuel and its mixing and vaporization with the incoming exhaust flow from the core engine.

The fuel shield itself has a limited size and extent and protects the leading edge region of the pilot vane from the incoming pilot fuel. The fuel shield is subject to the incoming hot exhaust flow from the core engine and is itself quenched by the injected pilot fuel during afterburner operation.

However, the limited size of the fuel shield itself correspondingly reduces thermal gradients in the fuel shield as opposed to those in the substantially larger pilot vane. The end mounted fuel shield is relatively flexible and freely expands and contracts during changes in temperature thereof for minimizing the thermal stresses therein during operation.

Accordingly, the fuel shield protects the leading edge region of the pilot vanes for substantially increasing the durability of those pilot vanes, with the fuel shields themselves having corresponding durability for substantially increasing the useful life of the entire flameholder during operation.

The fuel shields are relatively simple, thin, lightweight sheet metal pieces simply affixed around the leading edges of the pilot vanes to conform in configuration therewith and maintain aerodynamic efficiency and performance of the flameholder during operation.

Accordingly, the simple fuel shield 68 may be readily retrofit into existing augmented turbofan engines at a regular maintenance outage to substantially increase the useful life of the flameholder for subsequent operation over the flight envelope.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. An afterburner for a turbofan engine comprising:

a row of flameholder vanes joined to radially outer and inner shells;

each of said vanes including first and second sidewalls extending between leading and trailing edges;

a plurality of main fuel spraybars distributed circumferentially before said vanes;

a smaller plurality of pilot fuel spraybars positioned before leading edges of corresponding pilot vanes; and a plurality of fuel shields disposed between corresponding pilot vanes and said pilot spraybars, and covering said leading edges of said pilot vanes with a thermally insulating gap therebetween.

2. An afterburner according to claim 1 wherein each of said fuel shields comprises:

first and second wings obliquely joined together at a nose;

each of said wings having an offset tab at a proximal end thereof fixedly joined to said sidewalls; and said wings and tabs being complementary to said pilot vanes around said leading edges thereof, with said tabs offset from said wings to effect said gap between said wings and sidewalls.

3. An afterburner according to claim 2 wherein said wings include:

outer gutters joined thereto at arcuate fillets; and inner gutters joined thereto at arcuate fillets.

4. An afterburner according to claim 3 wherein:

said pilot vanes further include an outer fillet blending with said outer shell, and an inner bullnose blending with said inner shell; and said outer gutters conform with said outer fillets, and said inner gutters diverge from said bullnoses.

5. An afterburner according to claim 4 wherein said inner gutters diverge from said wings at a greater angle than said outer gutters.

6. An afterburner according to claim 4 wherein said inner and outer gutters increase in size from said nose to said opposite tabs.

7. An afterburner according to claim 4 wherein said outer gutter varies in fillet radius between said nose and tabs, and said inner gutter has a substantially constant fillet radius between said nose and said tabs.

8. An afterburner according to claim 4 wherein each of said fuel shields comprises a unitary sheet of metal.

9. An afterburner according to claim 4 wherein:

said outer gutters contact said outer fillets; and said inner gutters are spaced from said inner shell to partly cover said bullnoses.

10. An afterburner according to claim 4 wherein said wings increase in spacing from said pilot vane sidewalls between said tabs and nose, with said nose being aligned with said leading edge.

11. For a turbofan engine having an afterburner with a row of flameholder vanes each including first and second sidewalls joined together at opposite leading and trailing edges, a fuel shield comprising:

first and second wings having opposite forward and aft ends, and obliquely joined together at said forward ends at a nose;

each of said wings having an offset mounting tab at said aft ends; and said wings and tabs being configured to complement said flameholder vane around said leading edge, with said tabs contacting said sidewalls to offset said wings outwardly therefrom and form a gap therebetween.

12. For a turbofan engine having an afterburner with a row of flameholder vanes each including first and second sidewalls extending between leading and trailing edges, a fuel shield comprising:

first and second wings obliquely joined together at a nose;

each of said wings having an offset mounting tab at a proximal end and corresponding gutters extending between said nose and tabs; and said wings and tabs being configured to complement said flameholder vane around said leading edge, with said tabs contacting said sidewalls to offset said wings outwardly therefrom and form a gap therebetween.

13. A shield according to claim 12 wherein:

said vanes include an outer fillet; and said wings include outer gutters conforming with said fillet.

14. A shield according to claim 12 wherein:

said vanes include an inner bullnose; and said wings include inner gutters configured to diverge from said bullnose.

15. A shield according to claim 12 wherein said wings include:

outer gutters joined thereto at arcuate fillets; and inner gutters joined thereto at arcuate fillets.

16. A shield according to claim 15 wherein said inner gutters diverge from said wings at a greater angle than said outer gutters.

17. A shield according to claim 15 wherein said inner and outer gutters increase in size from said nose to said tabs.

18. A shield according to claim 15 wherein said outer gutter varies in fillet radius between said nose and tabs, and said inner gutter has a substantially constant fillet radius between said nose and tabs.

19. A shield according to claim 15 wherein said wings are substantially flat.

20. A shield according to claim 19 wherein said wings, gutters, nose, and tabs comprise a unitary sheet of metal.

21. A shield according to claim 15 in combination with said afterburner, and wherein fewer than all said vanes include a pilot fuel spraybar disposed in front of said vane leading edge, and said fuel shield is fixedly joined by said tabs to cover said leading edge behind a corresponding pilot spraybar.

22. An apparatus according to claim 21 wherein:

said afterburner further includes a radially outer shell fixedly joined to said flameholder vanes at said outer fillets, and a radially inner shell fixedly joined to said flameholder vanes at said inner bullnose;

said outer gutters contact said outer fillet; and said inner gutters are spaced from said inner shell to partly cover said bullnose.

23. An apparatus according to claim 21 wherein said wings increase in spacing from said vane sidewalls between said tabs and nose, with said nose being aligned with said leading edge.

* * * * *